US009955249B2

(12) United States Patent
Searl et al.

(10) Patent No.: US 9,955,249 B2
(45) Date of Patent: Apr. 24, 2018

(54) EARPIECE WITH MOVABLE JOINT

(71) Applicant: Bose Corporation, Framingham, MA (US)

(72) Inventors: Ellen I. Searl, Charlton, MA (US); Michael O Connell, Northborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/478,732

(22) Filed: Sep. 5, 2014

(65) Prior Publication Data

US 2016/0073186 A1 Mar. 10, 2016

(51) Int. Cl.
*H04R 1/10* (2006.01)

(52) U.S. Cl.
CPC ..... *H04R 1/105* (2013.01); *H04R 1/1016* (2013.01); *H04R 2201/109* (2013.01)

(58) Field of Classification Search
CPC .... H04M 1/05; H04M 1/6066; H04R 1/2803; H04R 1/1016; H04R 25/60; H04R 1/105; H04R 1/1058; H04R 1/1066; H04R 5/0335; A61F 11/00
See application file for complete search history.

(56) References Cited

U.S. PATENT DOCUMENTS 1,614,987 A * 1/1927 Langenbeck ..... H04R 25/65 181/135
1,893,143 A * 1/1933 Koch ..... H04R 25/60 181/135
1,953,437 A * 4/1934 Schier ..... A61F 11/00 128/864
5,712,453 A * 1/1998 Bungardt ..... H04R 1/1066 181/135
D576,610 S 9/2008 Johnson
8,249,287 B2 * 8/2012 Silvestri ..... H04R 1/1016 381/370

(Continued)

FOREIGN PATENT DOCUMENTS

EP 1 372 353 12/2003
EP 1372353 A1 * 12/2003 ..... H04B 1/385

(Continued)

OTHER PUBLICATIONS

Jaybird Bluebuds X Headphones, downloaded from the internet on Sep. 5, 2014 at http://www.jaybirdsport.com/bluebuds-x-bluetooth-headphones/, 3 pgs.

(Continued)

*Primary Examiner* — Fan Tsang
*Assistant Examiner* — Angelica M McKinney
(74) *Attorney, Agent, or Firm* — Fish & Richardson P.C.

(57) ABSTRACT

The subject technology can be embodied in an earpiece that includes a body, a retaining structure, and a movable joint structure. The body includes an acoustic passage for conducting sound waves. The retaining structure is configured to engage with external structural features to hold the body in position, and the movable joint structure is configured to couple the body to the retaining structure. The movable joint structure is also configured to allow angular motion of the body with respect to the retaining structure.

19 Claims, 8 Drawing Sheets

(56) References Cited

U.S. PATENT DOCUMENTS

| | | | | |
|---|---|---|---|---|
| 8,311,253 | B2 * | 11/2012 | Silvestri | H04R 1/1075 181/129 |
| 8,873,786 | B2 * | 10/2014 | Larsen | H04R 25/656 381/328 |
| 9,143,855 | B2 * | 9/2015 | Tan | H04R 1/105 |
| 2003/0174853 | A1 | 9/2003 | Howes et al. | |
| 2006/0067556 | A1 * | 3/2006 | Bailey | H04R 1/105 381/380 |
| 2006/0135223 | A1 * | 6/2006 | Kim | H04M 1/05 455/575.2 |
| 2006/0215864 | A1 * | 9/2006 | Espersen | H04R 25/656 381/330 |
| 2011/0031060 | A1 * | 2/2011 | Epping | H04R 1/2803 181/135 |
| 2011/0123059 | A1 * | 5/2011 | Hu | H04R 1/1016 381/380 |
| 2011/0255729 | A1 | 10/2011 | Tan et al. | |
| 2012/0039500 | A1 * | 2/2012 | Silvestri | H04R 1/1016 381/380 |
| 2013/0230204 | A1 * | 9/2013 | Monahan | H04R 1/1016 381/380 |
| 2015/0110320 | A1 | 4/2015 | Liu et al. | |

FOREIGN PATENT DOCUMENTS

| | | | |
|---|---|---|---|
| WO | WO 2007/022634 | 3/2007 | |
| WO | WO 2007022634 A1 * | 3/2007 | H04R 1/1066 |
| WO | WO 2009/030229 | 3/2009 | |
| WO | WO 2010/040350 | 4/2015 | |

OTHER PUBLICATIONS

International Search Report and Written Opinion; PCT/US2015/048277; dated Oct. 23, 2015; 13 pp.

International Search Report and Written Opinion; PCT/US2015/048269; dated Oct. 19, 2015; 15 pp.

International Preliminary Report on Patentability; PCT/US2015/048269; dated Mar. 16, 2017; 12 pages.

International Preliminary Report on Patentability; PCT/US2015/048277; dated Mar. 16, 2017; 9 pages.

* cited by examiner

EARPIECE WITH MOVABLE JOINT

CROSS REFERENCE TO RELATED APPLICATION

This application is related to co-filed application titled "Retaining Structure for an Earpiece," filed on Sep. 5, 2014 and bearing U.S. Pat. No. 14/478,902, the entire content of which is incorporated herein by reference.

TECHNICAL FIELD

This disclosure generally relates to earpieces for use with electronic devices.

BACKGROUND

Earpieces can be placed within human ears, e.g., as part of earphones, Bluetooth devices, etc., to deliver sound to the ears.

SUMMARY

In one aspect, this document describes an earpiece that includes a body, a retaining structure, and a movable joint structure. The body includes an acoustic passage for conducting sound waves. The retaining structure is configured to engage with external structural features to hold the body in position, and the movable joint structure is configured to couple the body to the retaining structure. The movable joint structure is also configured to allow angular motion of the body with respect to the retaining structure.

In another aspect, this document describes an earpiece that includes a body and a retaining structure. The body includes an acoustic passage for conducting sound waves, wherein the acoustic passage is disposed within the body. The body also includes a movable joint structure disposed on an outer surface of the body. The retaining structure is configured to engage with external structural features to hold the body in position, wherein the movable joint structure is configured to couple the body to the retaining structure, and allow angular motion of the body with respect to the retaining structure.

In another aspect, this document describes an earpiece that includes a body and a retaining structure. The body includes an acoustic passage for conducting sound waves, and the retaining structure is configured to engage with external structural features to hold the body in position. The retaining structure includes a movable joint structure that is configured to couple the retaining structure to the body, and allow angular motion of the body with respect to the retaining structure.

Implementations of the above can include one or more of the following features.

The movable joint structure can include a hinge. The movable joint structure can be configured to allow the angular motion along a plane perpendicular to an axis of the angular motion. The axis passes though the movable joint structure. The movable joint structure can be configured to allow the angular motion along a first plane substantially perpendicular to a second plane in which the retaining structure is disposed. The body can include a tip substantially conical in shape, the tip being configured to engage with the ear canal in a sealing configuration. A range of the angular motion can be ±90°. The body can be configured to house an acoustic driver module having a diameter between 4 mm and 5 mm. The body and the retaining structure can be removably coupled to the movable joint structure. A sealing structure can be disposed over the body, the sealing structure being configured to engage with the ear canal in a sealing configuration. The movable joint structure can be configured to have a stiffness that impedes the angular motion. The external structural features can include features of a human ear. The retaining structure can be configured to hold the body in position proximate to an ear canal of the human ear. A volume of the body can be less than 0.5 cubic centimeters.

In another aspect, this document features a retaining structure which is configured to engage with external structures to hold an earpiece in position. The retaining structure includes a first portion forming a loop and having an upper end and a lower end. The upper end of the first portion is coupled to a top surface of a body of the earpiece and the lower end of the first portion is coupled to a bottom surface of the earpiece. The retaining structure also includes a second portion having an upper end and a lower end, wherein the lower end of the second portion is coupled to the loop formed by the first portion, and the upper end of the second portion extends from the earpiece. The top and bottom surfaces are located on substantially opposite sides of the body in a direction along a plane in which the retaining structure is disposed.

In another aspect, this document features an eartip for an earpiece. The eartip includes a body including an acoustic passage, and a retaining structure configured to engage with external structural features of a human ear to hold the eartip in position. The body is configured to be coupled to an external acoustic driver, and the retaining structure includes a first portion forming a loop and having an upper end and a lower end. The upper end of the first portion is coupled to a top surface of the body and the lower end of the first portion is coupled to a bottom surface of the body. The retaining structure also includes a second portion having an upper end and a lower end, wherein the lower end of the second portion is coupled to the loop formed by the first portion, and the upper end of the second portion extends from the eartip. The body includes a sealing structure to be inserted into the ear canal of the ear. The first portion of the retaining structure is compliant in a direction parallel to a direction of insertion of the sealing structure into the ear canal, and the sealing structure has a lower compliance than the retaining structure in the direction parallel to the direction of insertion.

In another aspect, the document describes a retaining structure configured to engage with external structures to hold an earpiece in position. The retaining structure includes a first portion that forms a loop in a plane and has an upper end and a lower end. The upper end of the first portion is coupled to a top surface of a body of the earpiece and the lower end of the first portion is coupled to a bottom surface of the earpiece. The retaining structure also includes a second portion that has an upper end and a lower end, wherein the lower end of the second portion is coupled to the loop formed by the first portion, and the upper end of the second portion extends from the earpiece in the plane of the loop. The top and bottom surfaces are located on substantially opposite sides of the body in a direction along the plane of the loop. A compliance of the first portion in directions out of the plane of the loop is configured such that the retaining structure is allowed to bend in a manner that allows the retaining structure to effectively pivot around the body.

Implementations of the above aspects can include one or more of the following features.

The upper end of the second portion can be coupled to the loop of the first portion via a bridging portion that connects the first and second portions. The first portion can include a lower arm that extends below the body in the direction along the plane in which the retaining structure is disposed. The lower end of the first portion can be configured to provide out-of-plane compliance with respect to the plane in which the retaining structure is disposed when engaged with portions of the external structures. An axis of an acoustic passage within the body can be substantially out of the plane in which the retaining structure is disposed. A shape of the first portion can be configured to provide balanced compliance together with a sealing structure of the body. The external structural features can be features of a human ear. The retaining structure can be configured to hold the body in position proximate to an ear canal of the human ear.

The sealing structure can be compliant in a direction orthogonal to the direction of insertion. The second portion can be coupled to the loop via a bridging portion. A portion of the loop can extend below the bottom surface of the body along a plane in which the retaining structure is disposed. An axis of the acoustic passage can be substantially out of the plane in which the retaining structure is disposed. The retaining structure can be configured to hold the sealing structure in position against an opening of the ear canal of the human ear.

The lower end of the first portion can extend below the body along the plane of the loop. The external structural features can be features of a human ear, and the retaining structure can be configured to hold the body in position proximate to an ear canal of the human ear and to provide compliance with the features of the human ear. The upper end of the second portion can be coupled to the loop of the first portion via a bridging portion that connects the first and second portions. A portion of the loop can extend below the bottom surface of the earpiece along the plane of the loop. The first portion can be configured to hold the body in position proximate to an ear canal of a human ear.

Various implementations described herein may provide one or more of the following advantages. Discomfort and/or pain (for example at the anti-tragus or cymba concha of the ear) experienced by a wearer can be reduced, thereby allowing for comfortable use for long periods. Earpieces can be made more compliant for users with less common ear-features (e.g., smaller concha) without reducing the appeal of the earpieces to the majority of users. The bodies of the earpieces can be made smaller. By providing a design in which independently selected constituent parts can be joined together to form an earpiece, the number of combinations available from a given number of constituent parts can be increased. In some cases, the earpieces can be made side-independent, e.g., the same earpiece can be used for the left or right ear.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

This document describes earpieces that are configured to reduce discomfort for users. An earpiece can include a tip or nozzle that fits into the concha or ear canal, and a retaining structure that is configured to hold the tip in place using the concha and the anti-helix of the user as support. In some cases, interaction between the tip and the retaining structure may push the tip inward towards the ear canal such that the tip and earbud body pushes against one or more of the tragus, anti-tragus, and inner portion of ear canal. This can cause discomfort or even pain in some users. The present disclosure describes earpieces in which the tip and the retaining structure are coupled in a way that may reduce discomfort to the wearer. In the example implementations described herein, the left and right earpieces may mirror each other, but have the same structure and function.

Figure 1:
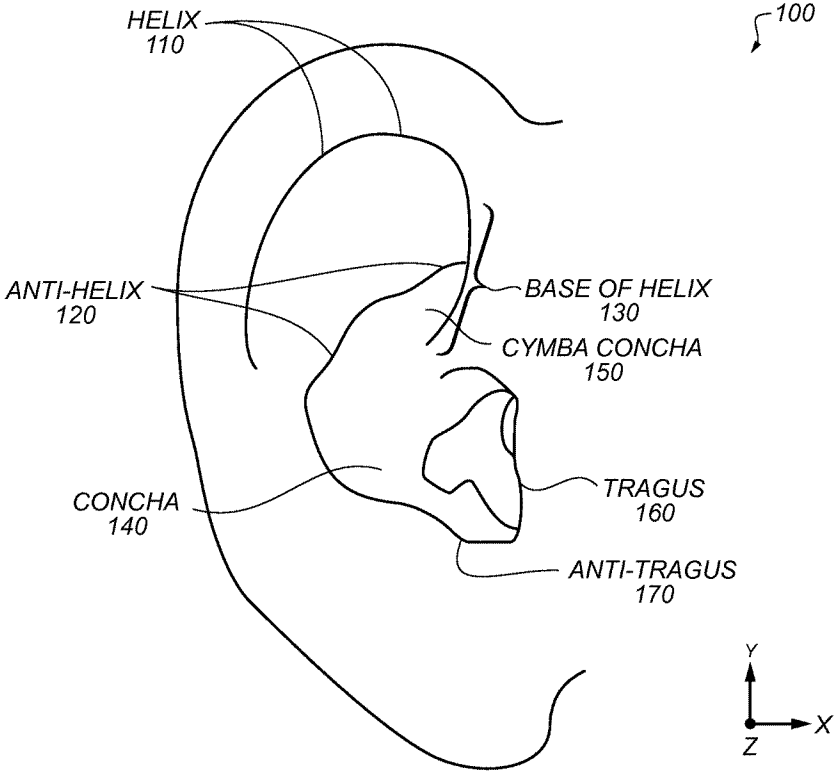
FIG. 1 is an exterior view of a human ear.

FIG. 1 shows an exterior view of a human right ear 100, with features of the ear identified. For example, FIG. 1 shows the helix 110, anti-helix 120, base-of-the-helix 130, concha 140, cymba-concha 150, tragus 160, and anti-tragus 170. However, different ears have different sizes and geometries. In this regard, the precise structure of the human ear varies from individual to individual. For example, some ears have additional features that are not shown in FIG. 1, and some ears may lack some of the features that are shown in FIG. 1. Likewise, some features of different ears may be more or less prominent than those shown in FIG. 1.

Figure 2B:
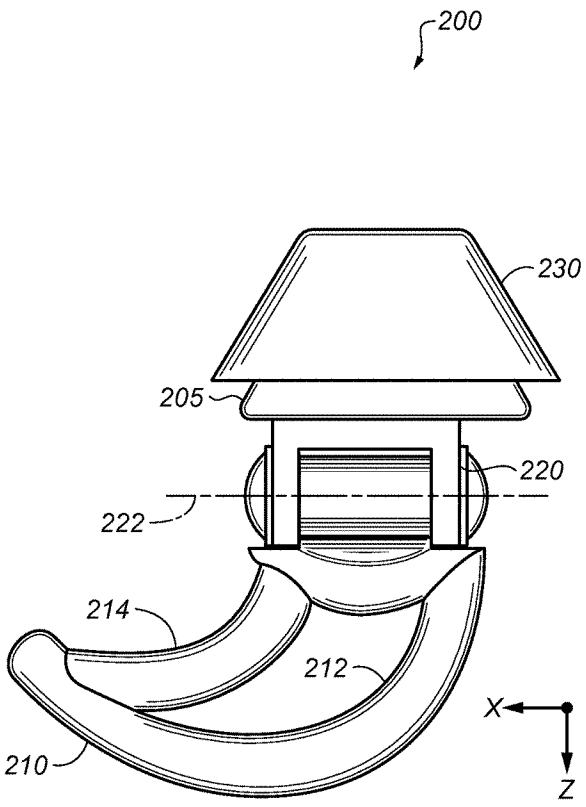
FIGS. 2A-2D are different views of a first example earpiece.
Figure 2A:
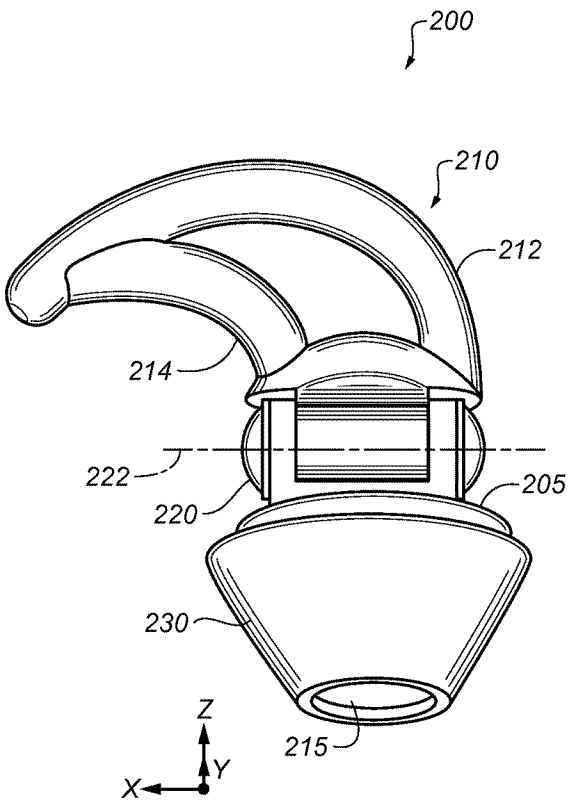
Figure 2D:
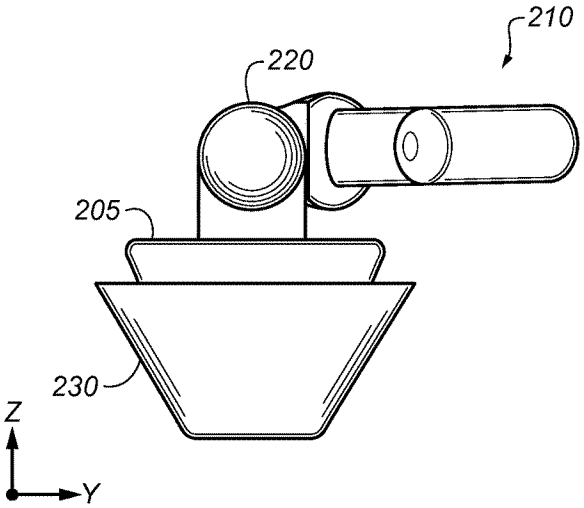
Figure 2C:
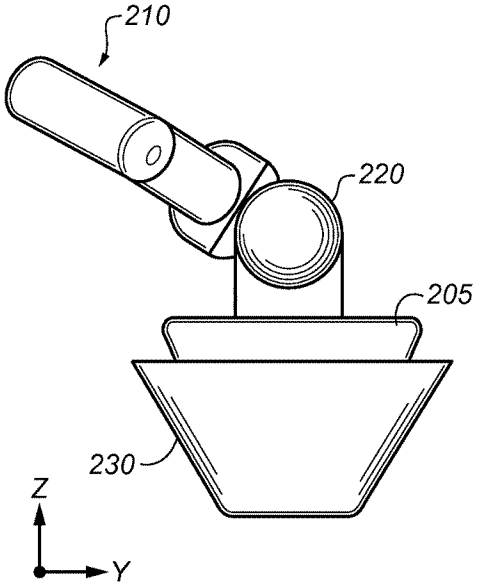
Figure 2E:
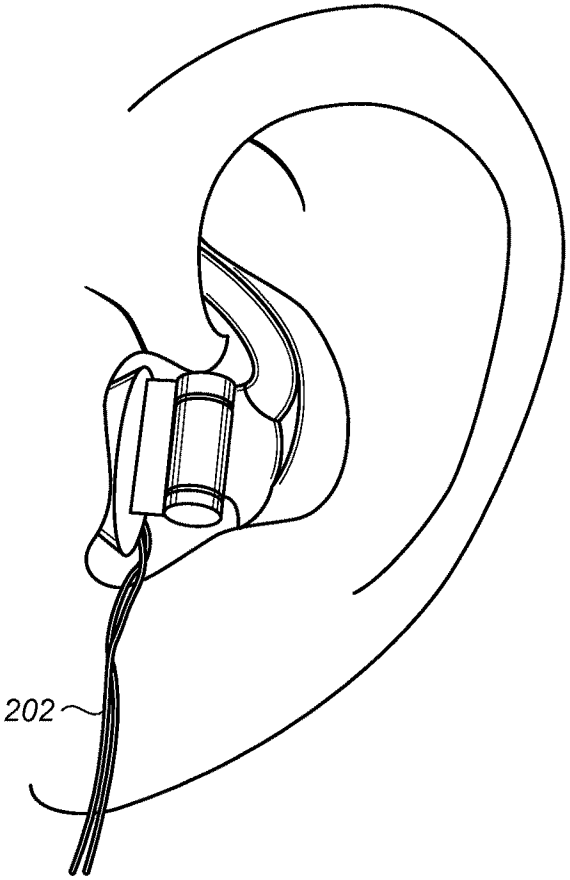
FIG. 2E shows an example of an earpiece as worn by a user.

FIGS. 2A and 2B show two different views of an example earpiece 200 that is configured to fit in the human ear 100. The earpiece 200 can be connected to an audio generating device, for example, using a connecting cable 202 (as shown in FIG. 2E). In some implementations, the earpiece 200 can include a stem for positioning the connecting cable 202. Some earpieces may lack the stem but may include electronics modules (not shown) for wireless communicating with corresponding audio generation devices. For example, an earpiece may be connected to the audio generation device wirelessly via a BLUETOOTH® transceiver disposed within the earpiece 200. Other earpieces may lack any connections and function as passive earplugs. In this context, a passive earplug includes an earplug that does not include acoustic features, e.g., they do not provide sound to the ear.

The earpiece 200 includes an acoustic driver module 215 disposed within a body 205. The body can include an acoustic passage for conducting sound waves to an ear canal of a user. In some implementations, the acoustic passage for conducting sound to the ear canal of the user can be disposed within a tip of the body 205. In some implementations, the tip can be covered by a sealing structure 230, which is configured to form a sealing fit with the exterior opening of the ear canal. Such a sealing fit reduces external noise entering the ear canal, thereby providing a passive noise attenuation arrangement.

The body 205 is coupled to a retaining structure 210 that engages with external structural features of the user's ear to provide mechanical stability for holding the earpiece 200 in place. For example, the retaining structure 210 can be configured to engage with a concha of the wearer, to hold the earpiece 200 in place. The retaining structure 210 can have various shapes and sizes. In the example shown in FIGS. 2A and 2B, the retaining structure 210 includes an outer portion 212 and an inner portion 214. In such cases, the outer portion 212 is curved to generally follow the curve of the anti-helix and/or the cymba concha at the rear of the concha. The outer portion 212 and the inner portion 214 can lie on one plane and can be connected to one another at least at one end. In some examples, the inner portion may be omitted and a single leg used to retain the earpiece.

In some implementations, the retaining structure 210 is coupled to the body 205 via a movable joint 220 such as a hinge. The movable joint 220 can be a separate structure to which the body 205 and the retaining structure 210 are coupled, in some cases in a removable way. In such cases, the body 205 and the retaining structure 210 are configured to include respective receptacles that can attach to the movable joint 220. In some implementations, the movable joint 220 can be an integral part of the body 205 or the retaining structure 210. In implementations where the movable joint 220 is an integral part of the body 205 (e.g., the movable joint 220 is disposed on the outside of the body 205), the movable joint 220 can be configured to couple with the retaining structure 210, in some cases, in a removable way. In such cases, the retaining structure 210 is configured to include receptacles that can attach to the movable joint 220. In implementations where the movable joint 220 is an integral part of the retaining structure 210, the movable joint 220 can be configured to couple with the body 205, in some cases, in a removable way. In such cases, the body 205 is configured to include receptacles that can attach to the movable joint 220.

The movable joint 220 allows the body 205 and the retaining structure 210 to rotate around an axis depicted by the line 222. The movable joint 220 allows for an angular motion of the body 205 with respect to the retaining structure 210 in a plane substantially perpendicular to the plane in which the outer portion 212 and the inner portion 214 of the retaining structure 210 is disposed. The body 205 can therefore be rotated (with respect to the axis 222) towards the exterior opening of the ear canal when the retaining structure 210 engages with the concha and/or the anti-helix. FIG. 2E depicts an example of the earpiece 200 worn by a user.

In some implementations, the movable joint 220 affects the interaction between the body 205 and the retaining structure 210 to impede the retaining structure 210 from pushing the body 205 into the ear canal in a way that is uncomfortable for the wearer. For example, because the retaining structure 210 is not rigidly coupled to the body 205, a force applied by the retaining structure along a direction into the ear canal can be absorbed, at least in part, by the movable joint 220, and may result in a rotational motion of the movable joint 220. As a result, the stiffness of the earpiece along the radial direction (i.e., pushing out towards the anti-helix) can be substantially decoupled from the stiffness of the earpiece along the axial direction (i.e., inwards into the ear canal). This in turn allows for the stiffness or size of the retaining structure 210 to be adjusted separately from the size of the body 205 and/or the stiffness of the movable joint 220, thereby facilitating a more comfortable custom fit for a wide range of wearers. For example, the retaining structure can be selected in a way such that it fits the concha and/or the anti-helix of the wearer to provide the desired stability. This can be done, for example, by allowing the wearer to select a retaining structure 210 from multiple available choices of varying sizes and stiffness. The body 205 and/or the sealing structure 230 can be selected independently such that the fit is comfortable for the wearer. The rotational stiffness of the movable joint 220 can be configured such that it provides enough axial push to hold the body 205 (and the sealing structure 230) in contact with the exterior opening of the ear canal without causing any discomfort to the wearer. By allowing for selecting the body 205 and the retaining structure 210 independently, a wider range of customizability can be achieved. For example, if the retaining structure 210 is available in three different variants (e.g., based on size and/or stiffness), and the body 205 is available in four different variants, a total of twelve combinations is possible. This allows for the product to be suitable for a wide range of wearers with varying ear geometry.

The movable joint 220 can have a range of angular swing sufficient to adapt to varying angles between the ear canal and helix across different users. In some implementations, the movable joint 220 can be configured such that the body 205 can rotate ±90° with respect to the retaining structure 210. This allows for the same earpiece to be used in either ear, thus obviating the need for separate mirror image designs. This requires fewer parts to be designed and manufactured and can be advantageous, for example, from a manufacturing cost standpoint. In particular, when multiple variants of the retaining structure 210 and body 205 are manufactured, and the various parts can be removably coupled to the movable joint structure 220, the side-independence of the earpiece 200 can result in significant savings and streamlining in the manufacturing and packaging processes.

In some implementations, a small acoustic driver module 215 can be used in the earpiece 200. The use of a small driver allows for the hinge axis 222 to be placed between the anti-helix and tragus. For example, a driver with a 4-5 mm diameter can be used in the earpiece 200. A large driver typically occupies the region between the anti-helix and tragus, and the axis of any hinge used with such a driver would be offset outward. A small driver can be housed within the body 205 and can therefore be aligned with the ear canal entrance. For example, the size of the driver can be such that the driver can be housed within a body of volume less than 0.5 cubic centimeter. In some implementations, the volume of the body 205 can be between 0.2 and 0.5 cubic centimeter (e.g., 0.25 cubic centimeter). Due to the small size of the driver, the driver or the body 205 does not have to angled with respect to the ear canal axis, and therefore the same driver (and by extension the same earpiece) can be used for either ear.

In operation, when the body 205 and the retaining structure 210 are in place, the retaining structure 210 and/or body 205 contact the ear of most people at two or more contact points. In some cases, the outer portion 212 contacts the anti-helix at the rear of the concha, and one end of the retaining structure 210 (i.e., the end at which the outer portion 212 and the inner portion 214 are connected to one another) is underneath the anti-helix. Some portions of the outer portion 212, or the body 205, or both are underneath the anti-tragus. The body 205 is inserted partially into the ear canal under the tragus. The contact points hold the earpiece in position, providing greater stability. The movable joint 220 facilitates a substantial decoupling of the force distribution and compliance associated with the retaining structure 210 and body 205, respectively, thereby providing a more comfortable and customized fit for a wide range of users having various ear geometries.

In some implementations, a tip of the body 205 is covered by the sealing structure 230. The sealing structure 230 can include a frusto-conical structure. In some implementations, the frusto-conical structure may have an elliptical or oval cross section, with walls that taper substantially linearly. In some implementations, the sealing structure 230 can be constructed of materials including silicones, TPUs (thermoplastic polyurethanes) and TPEs (thermoplastic elastomers).

In some implementations, one or more of the body 205, the retaining structure 210, the movable joint 220, and the sealing structure 230 may be made of, for example, a soft silicone rubber having a prerequisite hardness (e.g., 30 Shore A or less). The walls of the sealing structure 230 can be of a uniform thickness which may be very thin, for example, less than one millimeter. The walls of the sealing structure 230 can be configured to taper to the base of the frusto-conical structure so that the walls deflect easily, thereby conforming easily to the contours of the ear and providing a good seal and good passive attenuation without exerting significant radial pressure on the ear canal. In some implementations, different parts of the earpiece 200 can be made of different materials, such as materials with different hardness or moduli, that may be selected based on the function the corresponding portion is intended to serve. For example, the hardness of the retaining structure 210 may be selected for comfort (for example 12 Shore A), whereas the hardness of the body 205 may be slightly higher (for example 20 Shore A) for a better fit and seal.

Figure 4B:
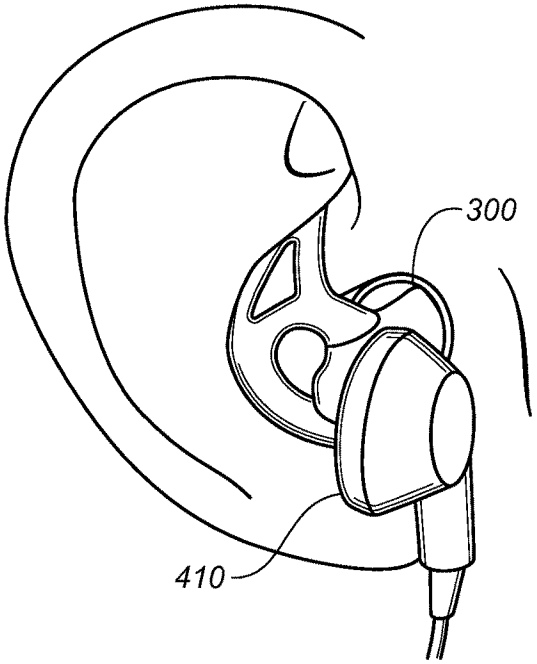
FIGS. 4A and 4B show examples of earpieces as worn by users.
Figure 4A:
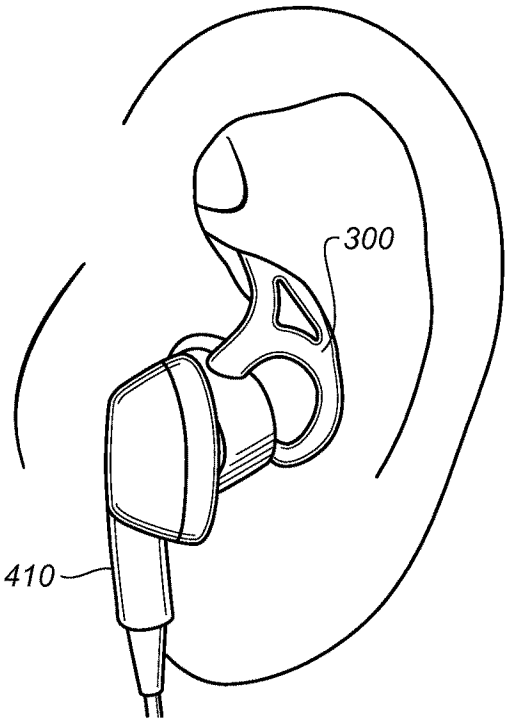

In some implementations, an earpiece without a movable joint can also be configured to achieve increased comfort levels for a wearer. For example, a retaining structure of an earpiece can be configured in a way such that an interaction between the retaining structure and the body of the earpiece does not result in undesirable effects such as increased axial pressure on the ear-canal or pressure on the anti-tragus. For example, an earpiece can include a suitably designed compliant eartip that can be coupled to a rigid acoustic driver. Such an eartip can serve as an interface between a rigid driver and the ear, thereby allowing the use of the rigid acoustic driver in an earpiece that is not uncomfortable to wear. Examples of such earpieces are shown in FIGS. 4A and 4B where rigid acoustic drivers 410 are coupled to compliant eartips 300.

FIGS. 3A-3F shows different views of such an eartip 300. For the eartip 300, the retaining structure 310 is configured such that an interaction between the retaining structure 310 and the body 305 (and by extension, the extended nozzle 307) does not axially push the nozzle 307 and/or sealing structure 330 into the ear canal in a way that causes discomfort for most wearers. The nozzle 307 includes an opening 340 at the outer end. The retaining structure 310 can be configured such that the pressure or axial force exerted into the ear canal of a wearer is consistent over a wide range of ear geometries in a way that the pressure does not cause a discomfort for the wearer. This can be accomplished, for example, by balancing compliant features of the nozzle 307 and the retaining structure 310. In some implementations, the retaining structure 310 can be removably connected to the body 305, for example, by a hinge structure.

Figure 3B:
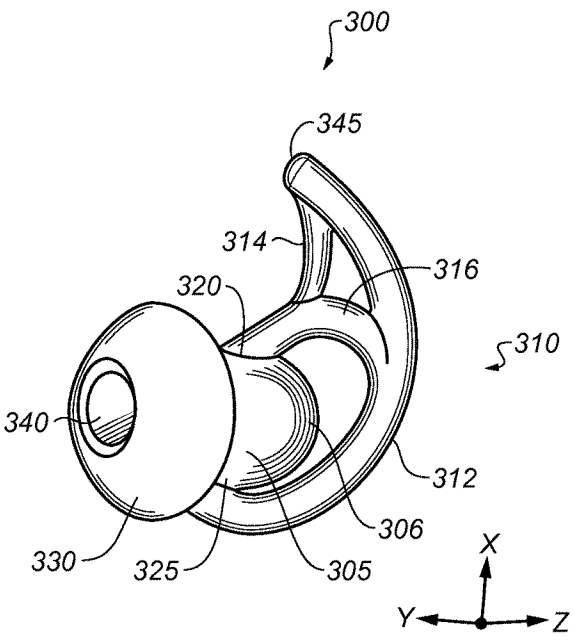
FIGS. 3A-3F are different views of a second example earpiece.
Figure 3A:
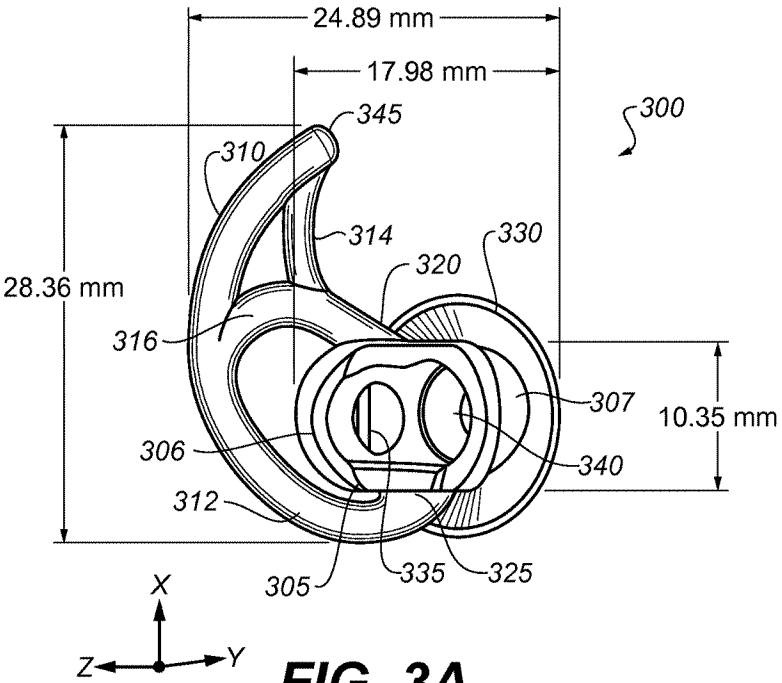

In some implementations, the eartip 300 has reduced axial push because of an outer portion 312 of the retaining structure 310 connected at a bottom portion 325 of the body 305. Example dimensions of the retaining structure 310 are shown in FIG. 3A. An inner portion 314 (or a bridging portion 316 that connects the outer portion 312 with the inner portion 314) of the retaining structure 310 is connected to a top portion 320 of the body 305. In some implementation, the bridging structure 316 can be used to increase stiffness of the outer portion 312 which applies force to the anti-helix. In some implementations, the bridging portion 316 may not be present.

Figure 3D:
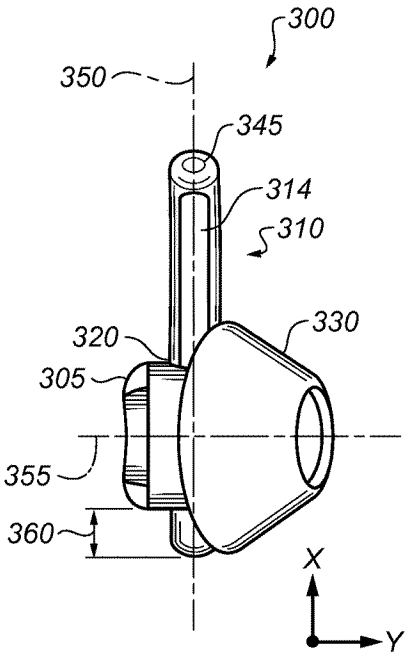
Figure 3C:
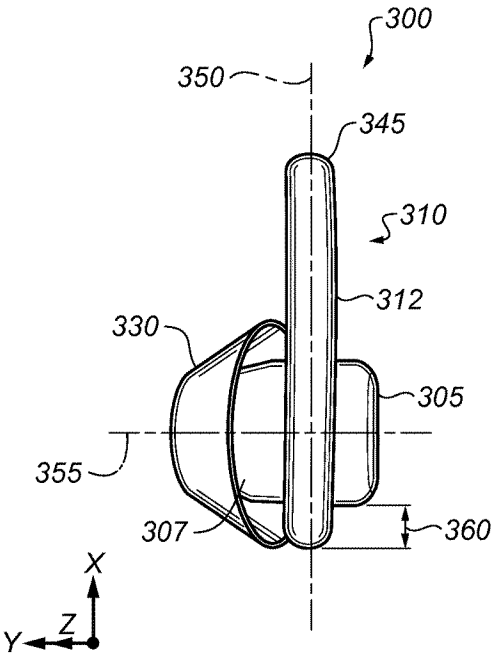
Figure 3F:
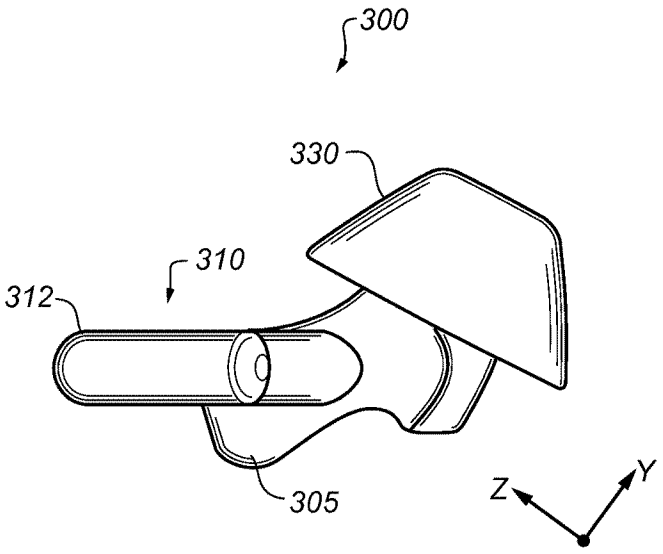
Figure 3E:
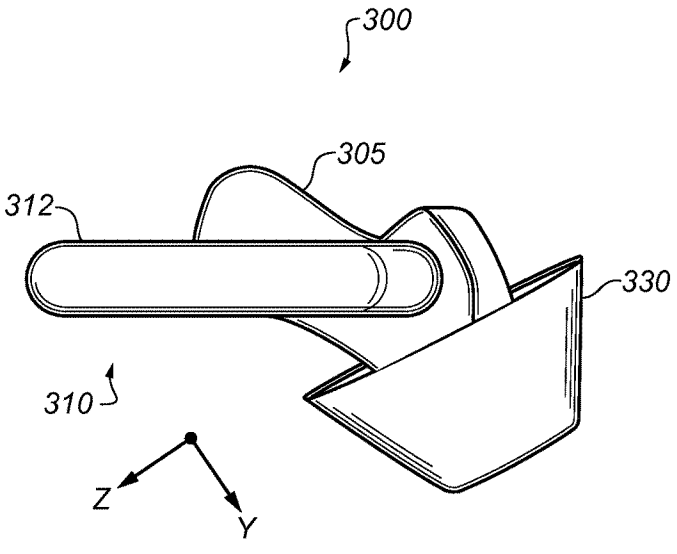

FIGS. 3C and 3D show that the retaining structure 310 is disposed along a plane represented by the line 350. When the eartip 300 is worn by a user, the plane represented by the line 350 matches up with the ear geometry such that the retaining structure 310 is placed into the anti-helix and under the anti-tragus. This can result in the compliance (i.e., an amount of displacement for a given amount of force) of the retaining structure 310 being in a substantially opposite direction to that of the compliance of the nozzle 307 or the sealing structure 330. The interaction between the retaining structure 310 and the sealing structure 330 can result in a comfortable fit for a wide range of population. In some implementations, an out of plane compliance can also contribute to a comfortable fit. For example, the outer portion 312 of the retaining structure 310 can be configured to be flexible, such that the outer portion 312 bends in and out to provide an even better overall fit.

In some implementations, the coupling between the retaining structure 310 and the body 305 can be adjusted such that the resulting axial push exerted by the retaining structure 310 is sufficient to create and maintain a seal between the eartip 300 and the ear canal, but not high enough to cause discomfort to the wearer.

As shown in FIGS. 3C and 3D, in some implementations, the retaining structure 310 extends below the body 305 by a distance 360. For example the outer portion 312 can have a lower arm that extends below the body and is attached to the bottom surface 325 of the body 305. In some implementations, the extension can be along the direction of the plane depicted by the line 350. In some implementations, the extension may be along a plane different from the plane represented by the line 350. In some implementations, the out of plane compliance allows a larger portion of the retaining structure 310 to be positioned below the body 305. Such out of plane compliance of the retaining structure also allows for improved fit with variation of ear canal to anti helix positions. In some implementations, the out of plane compliance can also reduce contact between the body 305 and the anti-helix.

In general, the retaining structure 310 can perform the functionality of engaging with a lower part of the anti-tragus or the concha (along with engaging with the anti-helix at the top) to provide stability to the eartip 300. As a result, because the body 305 does not have to engage with the anti-tragus or concha, the body 305 can be made small, for example, in the form of a 6 mm thick circular disk with less than a 12 mm diameter (or an oval disk with principal axes of 10 mm and 14 mm), to reduce contact with the ear, and to provide added compliance to the outer portion 312 of the retaining structure 310. FIG. 3A shows some example dimensions of the body 305. In some implementations, the body 305 only has to be large enough to accommodate the outlet of an acoustic driver module and couple with a nozzle 307. In some implementations, the body 305 includes a cavity 335 to receive the outlet of the driver module (e.g., the acoustic driver module shown in FIGS. 4A and 4B), and can be made only large enough to accommodate the outlet of the driver within the cavity 335. The rear end 306 of the body 305 can be shaped to accept the outlet of the driver within the cavity 335. The cavity 335 can be used, for example, to lock the eartip 300 onto a rigid acoustic driver module. In some implementations, the acoustic driver module (e.g., the driver module 410 shown in FIGS. 4A and 4B) can include a structural feature that couples to the cavity 335. Drivers of various sizes can be coupled to the eartip 300 via the cavity 335. For example, 8 mm, 12.4 mm, or 14.8 mm diameter drivers can be used. Because contact between the body 305 and the anti-tragus/concha is reduced, any discomfort resulting from an interaction of the body 305 with the ear is also reduced. In addition, compliance between the retaining structure 310 and the sealing structure 330 allow the body 305 to be better positioned in the ear, therefore resulting in reduced contact with the ear structures such as the tragus, anti-tragus, and anti-helix. In some implementations, the reduction in size of the body 305 allows the retaining structure 310 to move more freely.

In some implementations, a stability of the eartip 300 depends primarily on the retaining structure 310. The retaining structure 310 can be made compliant enough to engage with a wide range of population with varying ear geometries. For example, the retaining structure 310 can be made compliant enough for users with smaller conchae. Typically such users feel discomfort in wearing earpieces with large bodies. In some implementations, a small body 305, together with an appropriately shaped retaining structure 310 (e.g., one with a longer outer portion 312 for added compliance), makes the eartip 300 comfortable for such users. FIGS. 4A and 4B show two examples of earpieces being worn by users having relatively small conchae. In each of these examples, a relatively large acoustic driver (or speaker) 410 is adapted for the user using the compliant eartip 300 that fits the small concha.

The retaining structure 310 can be configured to provide sufficient compliance for the eartip 300 to fit a wide range of users with diverse ear geometries. In some implementations, the outer portion 312 can be shaped such that the outer portion 312 provides balanced compliance together with the sealing structure 330. Because the compliance of the retaining structure 310 is more than that of the body 305 or the sealing structure 330, the retaining structure 310 is configured to deform rather than push the body 305 or the sealing structure 330 uncomfortably deep into the ear canal. In some implementations, the stiffness (which resists bending) of the retaining structure 310 can be approximately 0.03 N/mm, while the stiffness of the sealing structure 330 (and/or the nozzle 307) can be approximately 0.3 N/mm, thereby making the retaining structure approximately ten times more compliant than the sealing structure 330. The compliance of the outer portion 312 can be adjusted, for example, based on using a material with an appropriate modulus of elasticity, and/or by adjusting the geometry (e.g., area of the cross section of the outer portion 312). The compliance of the nozzle 307 and the sealing structure 330 can also depend on geometries of the respective structures. Once the nozzle 307 is sealed against the ear canal (e.g., via the sealing structure 330), the compliance can be provided by the material used for the nozzle 307 and/or the sealing structure 330.

In some implementations, the lower part of the outer portion 312 (i.e. the portion that is connected to the bottom 325 of the body 305) provides additional out-of-plane compliance while reducing contact with the ear (e.g., with the anti-tragus). The out-of-plane compliance can be configured such that the seal between the sealing structure 330 and the ear canal is not compromised, yet a comfortable fit is achieved for the user.

In operation, the nozzle 307 (together with the sealing structure 330, where present) is placed in the ear and the eartip 300 is pushed gently inward. Pushing the eartip 300 into the ear causes the outer portion 312 to fit into a position underneath the anti-helix, and causes the opening or nozzle 340 to enter the ear canal by a small amount, depending on the dimensions and geometry of the entrance to the ear canal. In some cases, the eartip 300 can be rotated in one direction (e.g., counter-clockwise) for a better fit. The eartip 300 can then be rotated in the opposite direction (e.g., clockwise) until the eartip 300 cannot be further rotated. This can happen when, for example, the extremity 345 of the retaining structure 310 contacts the base of the helix, the inner portion 314 contacts the base of the helix, or the extremity 345 of the retaining structure 310 becomes wedged behind the anti-helix in the cymba concha region. At the lower end, the retaining structure 310 contacts the bottom portion of the concha and/or the anti-tragus to provide a comfortable and stable fit for the user. The exact way the retaining structure 310 engages with a particular user's ear can depend on the size and geometry of the user's ears. Therefore, by having a compliant retaining structure 310 and a small body 305, the eartip 300 can be made suitably comfortable for a wide range of users, including users with less common ear geometry such as medium to small sized conchae.

Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. An earpiece comprising:

a body comprising an acoustic passage for conducting sound waves, the body comprising a substantially conical tip having a first end and a tapered second end opposite to the first end, wherein the tapered second end is covered in part by a sealing structure;

a retaining structure comprising an outer portion, the retaining structure configured to engage with a user's ear to hold the body in position, wherein, when the earpiece is fit into the user's ear, the retaining structure is in contact with the antihelix of the user's ear along the length of the outer portion of the retaining structure, and an extremity of the retaining structure seats at an end of the antihelix under the helix of the user's ear; and a movable joint structure disposed between the body and the retaining structure, the movable joint structure disposed closer to the first end of the substantially conical tip than to the tapered second end of the substantially conical tip, and configured to allow angular motion of the substantially conical tip with respect to the retaining structure.

2. The earpiece of claim 1, wherein the movable joint structure comprises a hinge.

3. The earpiece of claim 1, wherein the movable joint structure is configured to allow the angular motion along a plane perpendicular to an axis of the angular motion.

4. The earpiece of claim 3, wherein the axis passes through the movable joint structure.

5. The earpiece of claim 1, wherein the movable joint structure is configured to allow the angular motion along a first plane substantially perpendicular to a second plane in which the retaining structure is disposed.

6. The earpiece of claim 1, wherein the sealing structure is configured to engage with the ear canal in a sealing configuration.

7. The earpiece of claim 1, wherein a range of the angular motion is ±90°.

8. The earpiece of claim 1, wherein the body is configured to house an acoustic driver module having a diameter between 4 mm and 5 mm.

9. The earpiece of claim 1, wherein the body and the retaining structure are removably coupled to the movable joint structure.

10. The earpiece of claim 1, wherein the movable joint structure is configured to have a stiffness that impedes the angular motion.

11. The earpiece of claim 1, wherein the retaining structure is configured to hold the body in position proximate to an ear canal of the human ear.

12. The earpiece of claim 1, wherein a volume of the body is less than 0.5 cubic centimeters.

13. An earpiece comprising:

a body comprising:

an acoustic passage for conducting sound waves, the acoustic passage being disposed within the body, a substantially conical tip having a first end and a tapered second end opposite to the first end, wherein the tapered second end is covered in part by a sealing structure, and a movable joint structure disposed on an outer surface of the body closer to the first end of the tip than to the tapered second end of the tip; and a retaining structure comprising an outer portion, the retaining structure configured to engage with a user's ear to hold the body in position, wherein, when the earpiece is fit into the user's ear, the retaining structure is in contact with the antihelix of the user's ear along the length of the outer portion of the retaining structure, and an extremity of the retaining structure seats at an end of the antihelix under the base of the helix of the user's ear, and wherein the movable joint structure is disposed between the body and the retaining structure, and is configured to allow angular motion of the substantially conical tip with respect to the retaining structure.

14. The earpiece of claim 13, wherein the movable joint structure comprises a hinge.

15. The earpiece of claim 13, wherein the movable joint structure is configured to removably couple the body to the retaining structure.

16. An earpiece comprising:

a body comprising an acoustic passage for conducting sound waves, the acoustic passage disposed within a substantially conical tip configured to engage with an exterior opening of an ear canal of a user; and a retaining structure comprising an outer portion, the retaining structure configured to engage with the user's ear to hold the body in position, wherein, when the earpiece is fit into the user's ear, the retaining structure is in contact with the antihelix of the user's ear along the length of the outer portion of the retaining structure, and an extremity of the retaining structure seats at an end of the antihelix under the base of the helix of the user's ear, and the retaining structure comprises a movable joint structure that is disposed between the retaining structure and the body, and is configured to allow angular motion of the substantially conical tip with respect to the retaining structure.

17. The earpiece of claim 16, wherein the movable joint structure comprises a hinge.

18. The earpiece of claim 16, wherein the movable joint structure is configured to removably couple the retaining structure to the body.

19. The earpiece of claim 1, wherein the body and the retaining structure each comprises one or more receptacles configured to attach to the movable joint structure.

* * * * *